US011670268B2

(12) United States Patent
Brown et al.

(10) Patent No.: US 11,670,268 B2
(45) Date of Patent: Jun. 6, 2023

(54) BROAD SPECTRUM AUDIO DEVICE DESIGNED TO ACCELERATE THE MATURATION OF STRINGED INSTRUMENTS

(71) Applicants: Gerald Francis Brown, Chapel Hill, NC (US); Isaac Daniel Derr, Hillsborough, NC (US)

(72) Inventors: Gerald Francis Brown, Chapel Hill, NC (US); Isaac Daniel Derr, Hillsborough, NC (US)

( * ) Notice: Subject to any disclaimer, the term of this patent is extended or adjusted under 35 U.S.C. 154(b) by 177 days.

(21) Appl. No.: 17/357,879

(22) Filed: Jun. 24, 2021

(65) Prior Publication Data

US 2022/0415292 A1 Dec. 29, 2022

(51) Int. Cl.

| | |
|---|---|
| ***G10H 1/00*** | (2006.01) |
| ***H04R 1/46*** | (2006.01) |
| ***G10D 3/14*** | (2020.01) |

(52) U.S. Cl.

CPC ..... *G10H 1/0091* (2013.01); *G10D 3/14* (2013.01); *H04R 1/46* (2013.01)

(58) Field of Classification Search

CPC ..... G10H 1/0091; G10H 3/14; H04R 1/46
See application file for complete search history.

(56) References Cited

U.S. PATENT DOCUMENTS 2,911,872 A * 11/1959 Carl ..... G10D 3/00 84/173
5,031,501 A * 7/1991 Ashworth ..... G10H 3/146 84/723
5,459,282 A * 10/1995 Willis ..... G10H 1/0066 84/645
5,537,908 A * 7/1996 Rabe ..... G10D 3/00 84/453
5,600,081 A * 2/1997 Simjian ..... G10D 3/22 84/453
6,320,113 B1 * 11/2001 Griffin ..... G10D 3/00 84/738
7,227,068 B1 * 6/2007 Van Doren ..... G10D 3/00 84/297 R
7,678,987 B2 * 3/2010 Lye ..... G10D 3/22 84/723
7,932,457 B2 * 4/2011 Hall ..... G10D 3/22 84/723
7,968,779 B2 * 6/2011 Courtright ..... G10D 3/22 84/320
7,977,555 B2 * 7/2011 Hall ..... G10D 3/22 84/291
7,977,565 B1 * 7/2011 Lye ..... G10D 3/00 84/723
8,134,064 B2 * 3/2012 Sanns, Jr. ..... G10H 3/18 84/723
8,642,877 B1 * 2/2014 Blish ..... G10H 3/22 84/723
8,662,245 B1 * 3/2014 Hall ..... G10K 11/17861 181/294

(Continued)

*Primary Examiner* — Robert W Horn

(57) ABSTRACT

The present invention comprises a device and process designed to accelerate the maturation of stringed musical instruments, composed of but not limited to a broad spectrum audio generator coupled with one or more fasteners via one or more armatures dimensioned to allow easy installation, secure attachment, and easy uninstallation from the stringed musical instrument.

3 Claims, 5 Drawing Sheets

(56) References Cited

U.S. PATENT DOCUMENTS

| | | | | |
|---|---|---|---|---|
| 9,412,347 | B2 * | 8/2016 | Kobayashi | G10F 1/16 |
| 9,583,076 | B2 * | 2/2017 | Nigro | G10D 3/00 |
| 9,589,551 | B2 * | 3/2017 | Langberg | G10H 3/24 |
| 10,121,457 | B2 * | 11/2018 | Gilbert | G10H 3/24 |
| 10,199,021 | B2 * | 2/2019 | Langberg | G10D 3/00 |
| 10,621,965 | B2 * | 4/2020 | Abiko | H04R 1/025 |
| 10,762,886 | B2 * | 9/2020 | Nakazawa | G10G 7/00 |
| 11,435,224 | B2 * | 9/2022 | Yang | G10G 5/00 |
| 2006/0117938 | A1 * | 6/2006 | Gillette | G10H 3/186 84/723 |
| 2009/0293707 | A1 * | 12/2009 | Suhr | G10D 3/22 84/723 |
| 2013/0047825 | A1 * | 2/2013 | Kernaghan | G10D 3/22 84/723 |
| 2022/0415292 | A1 * | 12/2022 | Brown | G10H 1/0091 |

* cited by examiner

A
S

4
B
B
4
3

3

2
A
1
SDL
2
B
SDL
A
P
4
1
P

3
SDL
2
P
A

A
S
4
B

B
4
3

3
2
1
SDL
B
P
A
4

A
2
SDL
P
1

3
SDL
2
P
A

A
S

4
B
B
4
3

3
2
1
SDL
B
P
A
4

A
2
SDL
P
1

3
SDL
2
P
A

BROAD SPECTRUM AUDIO DEVICE DESIGNED TO ACCELERATE THE MATURATION OF STRINGED INSTRUMENTS

FIELD OF INVENTION

The invention relates to a device and process of accelerating the aging process of stringed musical instruments for the purpose of ameliorating the sonic qualities of stringed musical instruments.

BACKGROUND

It is known that stringed musical instruments that have been played extensively garner superior sonic qualities when compared to similar stringed musical instruments that have not been played for the same amount of time. Specifically wooden bodied stringed musical instruments such as the guitar, bass, mandolin, violin, viola, etc. serve to benefit from extended play time. Many wish to imbue new or lightly used instruments with the same sonic qualities of extensively played instruments but lack the time necessary to achieve the results of hundreds if not thousands of hours of playtime. This invention autonomously simulates the physical auditory conditioning of extensive play via transmitting a sonic approximation of the complex polyphonic timbre of the instrument in question directly into the stringed musical instrument. The agitation of a stringed musical instrument via mechanical or vibratory methods cannot produce the menagerie of frequencies required to fully encompass the sonic range of any musical instrument. This invention is capable of producing a vast array of fundamental and harmonic frequencies at any given moment, each frequency allowing for variable pitch and amplitude, fulfilling the need to both accurately and autonomously imbue stringed musical instruments with the superior sonic characteristics of a regularly played vintage instrument, without necessitating extensive hands on play time. In addition, this device circumvents physical wear to the frets and strings of the instrument saving the user both time and maintenance costs while still garnering the results of extended play.

A SHORT SUMMARY OF THE INVENTION

The present invention serves the needs of those who deal with, manufacture, and play stringed musical instruments by providing a device that closely emulates the physical conditioning otherwise only obtainable through prolonged playtime. The process of emulating playtime will henceforth be referred to as "maturation." The present invention is purpose built to attach a broad spectrum audio device to virtually any stringed musical instrument via a cantilever action by entrapping the device at the tangent point formed between the saddle or bridge of the stringed musical instrument and one or more strings of the stringed musical instrument, ensuring a safe yet positive acoustic couple between the present invention and the stringed musical instrument. The present invention uses a large bandwidth of sonic frequencies that encompass the natural range of many if not all stringed musical instruments and allows the user to selectively curate which frequencies to condition their stringed musical instrument, whether the frequencies be synthesized by the broad spectrum audio device of the present invention, or via an external processor that transmits audio data to the device by wireless or wired connection.

The present invention is composed of, but not limited to: an attachment rail, hook, or any other suitable configuration of one or more fasteners coupled to a broad spectrum audio device via one or more armatures. The attachment rail, hook, or any other suitable configuration of one or more fasteners affix the device behind the strings of a stringed musical instrument, allowing the device to utilize the bridge, bridge pins, and or saddle of the stringed musical instrument as a fulcrum, creating a cantilever action, and a means of autonomously transmitting audio waves from the aforementioned broad spectrum audio device into the bridge, bridge pins, and or saddle of the stringed musical instrument, accelerating the maturation of the stringed musical instrument; wherein the attachment rail, hook, or any other suitable configuration of one or more fasteners and armature or armatures are dimensioned to allow the attachment rail, hook, or any other suitable configuration of one or more fasteners to rest at the tangent point formed by the strings and the bridge and or saddle of the stringed musical instrument, positioning the audio generator against the bridge, bridge pins, and or saddle of the stringed musical instrument. When positioned correctly, the device cannot become detached from the stringed musical instrument without the direct intent of the user due to the dimensions of the armature or armatures and fastener or fasters.

These and other embodiments, advantages, and features of this invention will be apparent from the following description, drawings, and appended claims.

DETAILED DESCRIPTION

Figures 1, 2, 3, 4, 5:
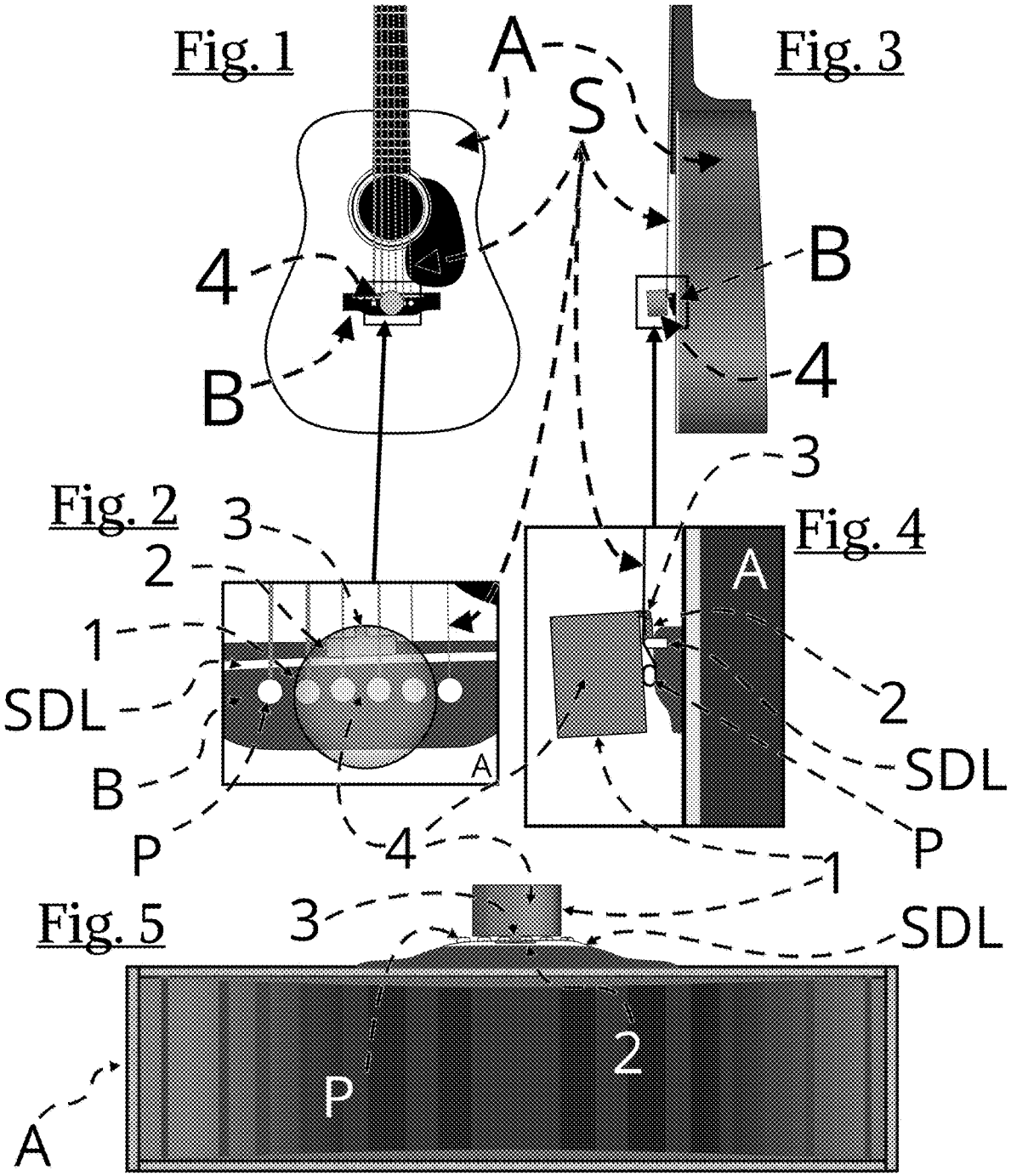
FIG. 1. A front view of an embodiment of the device attached to the strings of a guitar.
FIG. 2. An expanded view of FIG. 1 highlighting the means of attaching the device to the guitar.
FIG. 3. A side view of an embodiment of the device attached to the strings of a guitar.
FIG. 4. An expanded view of FIG. 2 highlighting the means of attaching the device to the guitar.
FIG. 5. A cross section view of a guitar looking toward the butt of the guitar highlighting the means of attaching the device to the guitar.

The object of the present invention is to provide a device and method to accelerate the maturation of stringed musical instruments. The present invention is specifically designed to universally affix a broad spectrum audio device to any stringed musical instrument via a cantilever action by entrapping the device at the tangent point formed between the saddle or bridge of the stringed musical instrument and one or more strings of the stringed musical instrument, ensuring an efficient and safe acoustic couple between the present invention and the stringed musical instrument. The device is composed of, but not limited to a broad spectrum audio device that is capable of generating frequencies from around 30 hz to 22 khz, easily encompassing the sonic range of most if not all stringed musical instruments, one or more armatures used to correctly position the present invention on the stringed musical instrument, and one or more fasteners that, when correctly positions at the tangent point formed between the strings and saddle or bridge of a musical instrument acoustically integrate the device with the instrument. The aforementioned broad spectrum audio device serves to autonomously simulate the acoustic conditions of extended play and, in doing so, accelerates the otherwise lengthy maturation process of said musical instrument. Specifically wooden bodied stringed musical instruments such as the guitar, bass, mandolin, violin, viola, etc. serve to benefit from this device, all of which possess a bridge that acts as the primary acoustic transmission point between the sonic waves generated by the strings of the instrument and the body of said instrument. Said bridge also serves as the transmission point for the audio generated by the present invention, greatly enhancing the realism of simulated play, further aiding in the effectiveness of accelerating the maturation process. Some electric instruments such as but not limited to the electric guitar, electric mandolin, electric bass, electric ukulele, etc. may also serve to benefit from the present invention.

The broad spectrum audio device can be configured to either generate audio frequencies or receive frequencies transmitted from an external source via a hard wire connection or via wireless audio data. The broad spectrum audio device is composed of but not limited to an DAC (Digital Audio Converter) that is capable of receiving and decoding digital audio signal, whether via a cable or wireless connection, and converting it into electric AC signal and an amplifier circuit that is capable of amplifying said AC signal in order to drive a coil for the purpose of moving either a speaker cone or transducer element for the purpose of transmitting audio to the stringed musical instrument. Likewise the broad spectrum audio device is capable of receiving analog audio signals via an auxiliary input for the purpose of playing external analogue audio signals through the amplifier circuit in order to drive a speaker or transducer element as previously described. The broad spectrum audio device is capable of receiving power from either an internal battery or from an external 120 v AC to DC rectifier power supply.

The present invention is a device composed of, but not limited to: an attachment rail, hook, or any other suitable configuration of one or more fasteners coupled to a broad spectrum audio generator via one or more armatures. The attachment rail, hook, or any other suitable configuration of one or more fasteners affixes the device behind one or more strings of a stringed musical instrument, allowing the device to utilize the bridge, bridge pins, and or saddle of the stringed musical instrument as a fulcrum, creating a cantilever action, and a means of autonomously transmitting audio waves from the aforementioned broad spectrum audio generator into the bridge, bridge pins, and or saddle of the stringed musical instrument, accelerating the maturation of the stringed musical instrument; wherein the attachment rail, hook, or any other suitable configuration of one or more fasteners and armature or armatures are dimensioned to allow the attachment rail, hook, or any other suitable configuration of one or more fasteners to rest at the tangent point formed by one or more strings and the bridge and or saddle of the stringed musical instrument, positioning the audio generator against the bridge, bridge pins, and or saddle of the stringed musical instrument so that the device cannot become unintentionally detached from the stringed musical instrument.

When affixed to a stringed musical instrument, the broad spectrum audio device is coupled to the stringed musical instrument via a configuration of one or more fasteners that are in turn connected to the broad spectrum audio device via one or more armatures. The device is held to the instrument due to the configuration of fasteners being entrapped by one or more strings so that the device may not become unintentionally detached from the stringed musical instrument. Furthermore the broad spectrum audio device is held against any number of suitable bridge components known to the Art by the force of gravity acting on the mass of the present invention. Due to the specific dimension of the armature or armatures the force of gravity is redirected into the bridge components of the instrument via a cantilever action. At no point, assuming proper installation, is the device affixed to the strings, bridge, or any other component of the stringed musical instrument via friction, adhesion, spring tension, suction, or a "gripping" action.

The present invention is entrapped by a string or strings of a stringed musical instrument, providing a vertically or semi vertically positioned stringed musical instrument, via a cantilever action. Said cantilever action utilizes a string or strings of the aforementioned instrument as a point of leverage for the fastener or fasteners, so that any bridge or bridge component known to the Art, acts as a fulcrum over which the majority of the weight of the device is balanced. When the fastener or fasteners are correctly positioned behind the strings and buttressed by the bridge or saddle, the fastener or fasteners cannot be freed from this configuration without the direct intent of the user. The gravitational force acting on the device is subsequently transferred into the bridge component that the broad spectrum audio device is levered over. In addition, the force of gravity also applies the weight of the device to the bridge or saddle of the stringed musical instrument via the fastener or fasteners creating a second point of acoustic coupling for the transfer of audio waves generated by the broad spectrum audio device. Said downward force not only serves to secure the device but also aids in a more efficient sonic transfer between the device and the aforementioned instrument. It is known in the Art that as a sound source grows nearer to a physical body, the transfer of sonic energy between the sound source and acoustic body increases and, on contacting the physical body, the efficiency of sonic transfer greatly increases. As the force creating an acoustic bond between a sound source and a physical body increases, so too does the efficiency of the sonic transfer. The present invention takes advantage of these physical properties as the weight of the device is firmly coupled to the natural sonic entry points of the stringed musical instrument, whether the device be coupled to the pins, bridge, and or saddle of the stringed musical instrument.

The outer extremities of the device are composed of a material that, when positioned at the tangent point formed by the strings and bridge or saddle of a stringed musical instrument, does not significantly hamper the ability of the strings to vibrate. Due to the rigidity of the material and close proximity of the fastener or fasteners to the bridge the strings are allowed to sympathetically vibrate with any of the frequencies generated by the device. Metal, glass, plastic, wood, or any other such rigid material would be suitable but metal has been determined to have superior acoustical properties due to its density and rigidity.

The broad spectrum audio device may either be permanently affixed to one or more armatures and subsequent configuration of one or more fasteners or the device may be configured so that the broad spectrum audio device is removable from a substructure comprised of but not limited to one or more armatures and subsequent configuration of one or more fasteners. The ability to interchange broad spectrum audio devices allows the manufacturer or user to incorporate rapidly changing technology and insure long term relevancy of the present invention.

The present invention is dimensioned so that, on proper installation, sonic frequencies are transmitted efficiently from the broad spectrum audio device into the bridge of the stringed musical instrument. Due to the efficiency at which audio waves are transmitted from the device into the bridge of the aforementioned instrument, the audio waves are subsequently transmitted into the body of the stringed musical instrument with minimal loss of sonic energy to heat or "chatter."

The present invention, whether permanently bound to a configuration of one or more armatures and fasteners, or temporarily inserted within a substructure comprised of but not limited to the previously mentioned components, as a whole comprises an integral structure composed of a broad spectrum audio device, armature or armatures, and any appropriate configuration of one or more fasteners.

The present invention, comprising a broad spectrum audio device, is designed so that the user may select one or more waveforms each comprising a variable wave shape, frequency, and amplitude, that are specific to the range and tuning of any stringed musical instrument. For example, the acoustic guitar, tuned to standard tuning, the fundamental frequencies of the strings: E2 82.41 Hz, A2 110.00 HZ, D3 146.83 Hz, G3 196.00 Hz, B3 246.94, and E4 329.63 Hz are all well within the range of output of the broad spectrum audio device, so too are the overtones of a guitar tuned to standard tuning. The broad spectrum audio device whether via internal software or with the aid of an external processor is capable of receiving user input in order to generate any number of frequencies within its sonic range of 30 Hz to 22 kHz in order to create a vast array of frequency combinations tailored to the tuning and frequency response specific to any instrument. Thus the user is given the option of not only choosing which fundamental frequencies they wish to exercise, but are also given the option to exercise the overtones of their instruments, whether as a primary exercise or in addition to the fundamental frequencies of their musical instrument.

The present invention, comprising of a broad spectrum audio speaker, presuming a stringed musical instrument to which the device is affixed, is capable of not only receiving audio data from an internal or external processor, but is also capable of receiving real time audio feedback from the aforementioned musical instrument via an internal microphonic element and decoding said audio feedback, whether internally or via an external microcontroller or processor, so that the user may analyze the metrics of the maturation process and adjust the settings of the device accordingly.

Several depictions and descriptions of alternative embodiments have been included in the present drawings. FIGS. 1-5 and FIGS. 20-21 depict an embodiment of the present invention having two anti-facing hooks that both stem from the same point of the cylindrical housing of the embodiment. FIGS. 6-10 and FIGS. 16-17 depict an embodiment having a pair of hooks being spaced apart as. FIGS. 11-15 and FIGS. 18-19 depict an embodiment having a singular hook shaped to form a channel that entraps a string of the instrument.

The Figures represent particular embodiments, and are not intended to be construed as limiting the invention.

Referring now to the Figures,

FIG. 1 is a front view of an embodiment of the invention 4 attached to the strings S and one or more bridge components, in this case the saddle and pins of a guitar A illustrated having strings S and a bridge B.

FIG. 2 being an expanded view of FIG. 1 shows an embodiment of the invention attached to the strings S and saddle SDL of a guitar A illustrated having strings S, a bridge B, saddle SDL, pins P, and a cylindrical housing made to house a speaker 1 coupled to a pair of anti-faced hooks 2. The hooks 2 are placed behind the strings S and pressed flush against the saddle SDL of the instrument by the force of gravity acting on the mass of the device, allowing the present invention to hang freely without significantly dampening the strings S of the musical instrument.

FIG. 3 is a side view of an embodiment of the invention 4 attached to the strings S and one or more bridge components, in this case the saddle and pins of a guitar A illustrated having strings S and a bridge B.

FIG. 4 is an exploded view of FIG. 3 that depicts an embodiment of the device 4 attached to the strings S and saddle SDL of a guitar A. FIG. 4 illustrates how the device 4 is hung from the tangent point formed by the strings S and the saddle SDL of the guitar A via a pair of anti-faced hooks 2, only one of which is visible in this depiction. The hooks 2 are specifically dimensioned to create the proper break angle between the cylindrical housing 1 and any suitable bridge component known to the Art, in this case the pins P to allow the device 4 to hang freely against the bridge B of the stringed instrument by the device's own weight.

FIG. 5 is a cross section view that depicts an embodiment of the device 4 attached to the strings S and saddle SDL of a guitar A. Further, FIG. 5 depicts an end view of a guitar A looking towards the butt of the instrument from the perspective of the headstock so as to illustrate how the hooks 2 are hooked under the strings S of the instrument A and rests at the tangent formed by the strings S and the saddle SDL.

FIG. 6-10 depict an alternative embodiment of the device where the hooks 2 originate from two equidistant points on the cylindrical housing 1.

Figures 6, 7, 8, 9, 10:
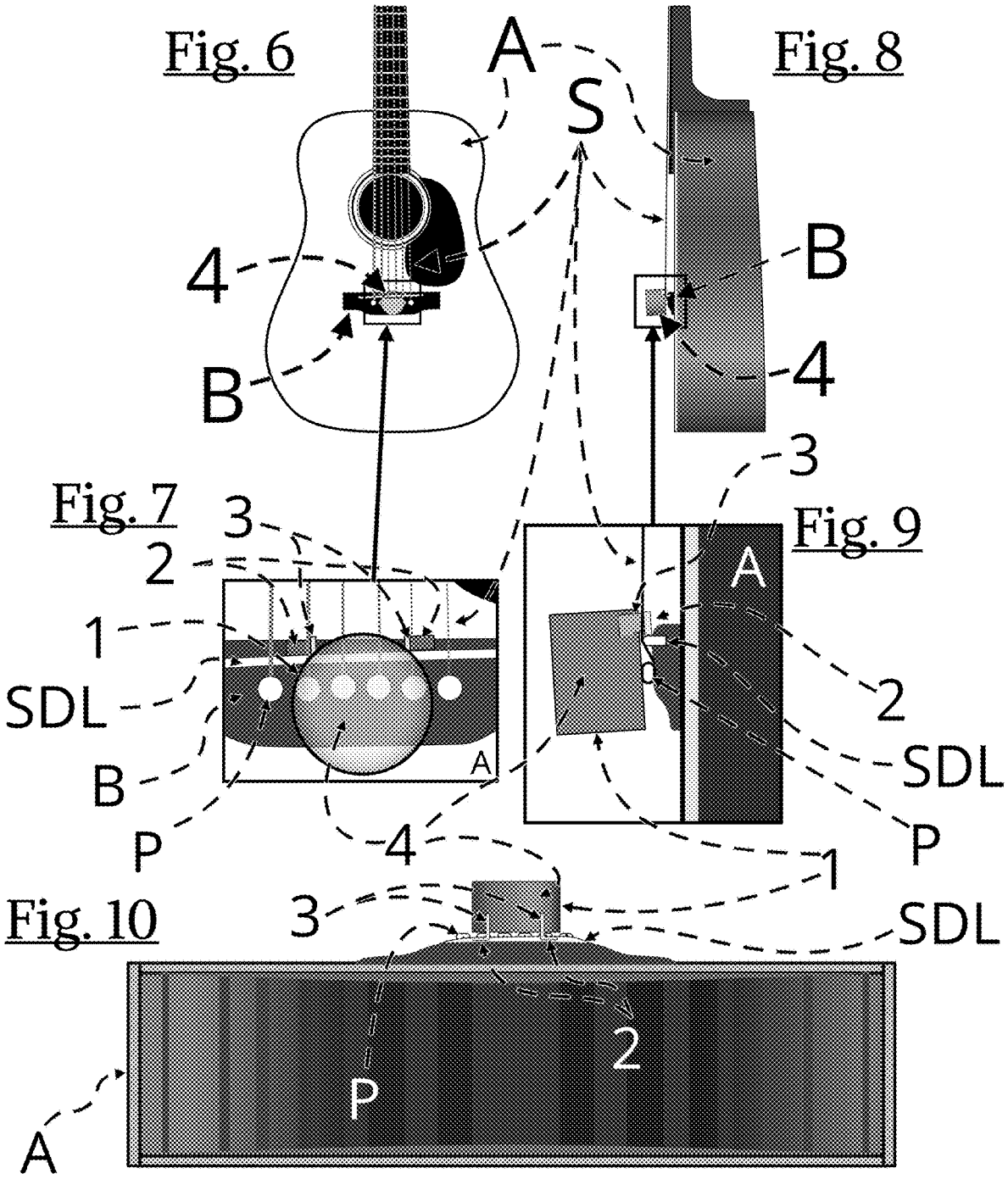
FIG. 6. A front view of an alternative embodiment of the device attached to the strings of a guitar.
FIG. 7. An expanded view of FIG. 6 highlighting the means of attaching the device to the guitar.
FIG. 8. A side view of an alternative embodiment of the device attached to the strings of a guitar.
FIG. 9. An expanded view of FIG. 8 highlighting the means of attaching the device to the guitar.
FIG. 10. A cross section view of a guitar looking toward the butt of the guitar highlighting the means of attaching an alternative embodiment of the device to the guitar.

FIG. 6 is a front view of an embodiment of the invention 4 attached to the strings S and bridge B of a guitar A illustrated having strings S and a bridge B. The depiction calls to attention an alternate configuration of the present invention having a pair of mirrored hooks 2, the distance between which disallows the device to unintentionally become detached from the guitar A.

FIG. 7 being an expanded view of FIG. 6, shows an embodiment of the invention 4 attached to the strings S and saddle SDL of a guitar A illustrated having strings S, a bridge B, saddle SDL. The figure shows how the hooks 2 sit behind two strings S of the guitar A so that the hooks rest against the saddle SDL of the guitar A and the cylindrical housing 1 hangs freely against the bridge B and bridge pins P of the guitar A.

FIG. 8 is a side view of an alternate embodiment of the present invention 4 attached to the strings S and one or more bridge components, in this case the saddle and pins of a guitar A illustrated having strings S and a bridge B.

FIG. 9 is an exploded view of FIG. 8 that depicts an alternate embodiment of the device 4 attached to the strings S and saddle SDL of a guitar A. FIG. 9 illustrates how the device 4 is hung from the tangent point formed by the strings S and the saddle SDL of the guitar A via a pair of anti-faced hooks 2, only one of which is visible in this depiction. The spacing of the hooks 2 in this embodiment disallows the device from becoming unintentionally detached from the guitar A.

FIG. 10 is a cross section view that depicts an alternate embodiment of the device 4 attached to the strings S and saddle SDL of a guitar A. Further, FIG. 10 depicts an end view of a guitar A looking towards the butt of the instrument from the perspective of the headstock so as to illustrate how the hooks 2 are hooked under the strings S of the instrument A and rests at the tangent point formed by the strings S and the saddle SDL.

Figures 11, 12, 13, 14, 15:
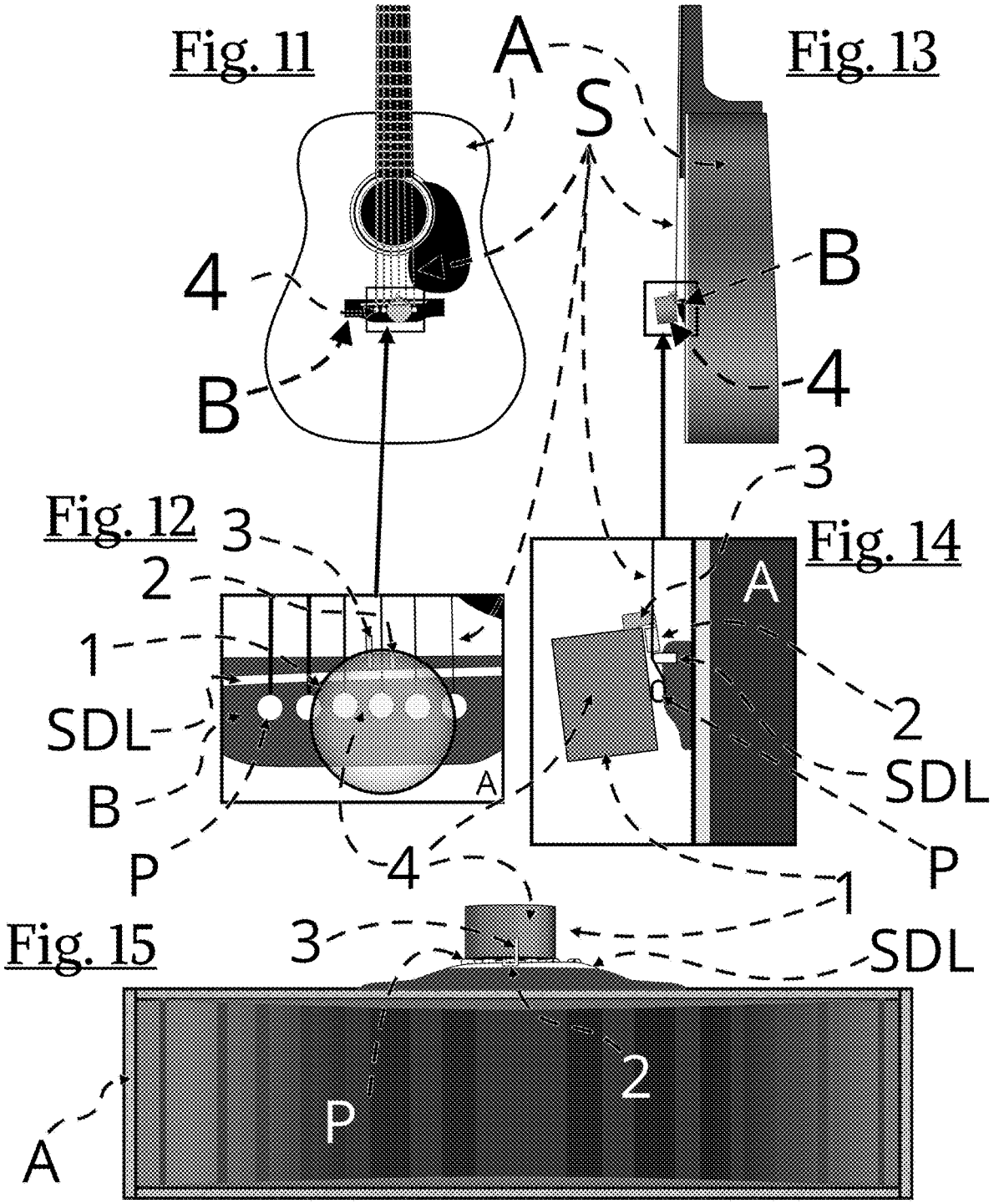
FIG. 11. A front view of an alternative embodiment of the device attached to the strings of a guitar.
FIG. 12. An expanded view of FIG. 11 highlighting the means of attaching the device to the guitar.
FIG. 13. A side view of an alternative embodiment of the device attached to the strings of a guitar.
FIG. 14. An expanded view of FIG. 13 highlighting the means of attaching the device to the guitar.
FIG. 15. A cross section view of a guitar looking toward the butt of the guitar highlighting the means of attaching an alternative embodiment of the device to the guitar.

FIG. 11 is a front view of an alternate embodiment of the invention 4 attached to the strings S and bridge B of a guitar A illustrated having strings S and a bridge B. The depiction calls to attention an alternate configuration of the present invention having a singular hook.

FIG. 12 being an expanded view of FIG. 11 shows an embodiment of the invention attached to the strings S and saddle SDL of a guitar A illustrated having strings S, a bridge B, saddle SDL, pins P, and a cylindrical housing 1 coupled to single hook 2. The hook 2 is placed behind the strings S and hangs freely by the weight of the device 4.

FIG. 13 is a side view of an alternate embodiment of the present invention 4 attached to one or more strings S and one or more bridge components, illustrated having strings S and a bridge B.

FIG. 14 is an exploded view of FIG. 13 that depicts an alternate embodiment of the device 4 attached to a string S and saddle SDL of a guitar A. FIG. 14 illustrates how the device 4 is hung from the tangent point formed by a string S and the saddle SDL of the guitar A via a singular hook 2 so as to allow the device 4 to hang freely.

FIG. 15 is a cross section view that depicts an alternate embodiment of the device 4 attached to the strings S and saddle SDL of a guitar A. Further, FIG. 15 depicts an end view of a guitar A looking towards the butt of the instrument from the perspective of the headstock so as to illustrate how the hook 2 is hooked under the strings S of the instrument A and rests at the tangent formed by the strings S and the saddle SDL allowing the device 4 to hang freely by its own weight.

Figure 16:
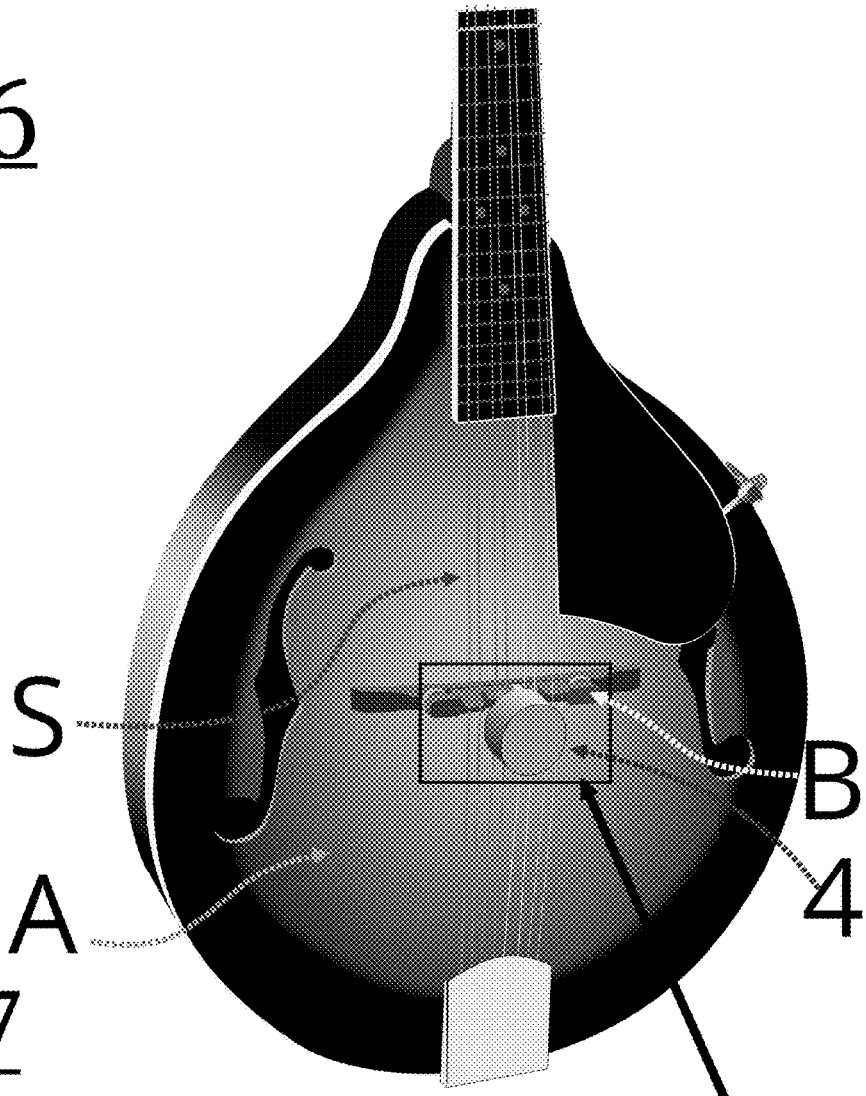
FIG. 16. A perspective view of an embodiment of the device attached to the strings of a mandolin.

FIG. 16 is a perspective view of an embodiment of the present invention 4 as previously depicted in FIGS. 1-5, shown attached to the bridge B and strings S of a mandolin A.

Figure 17:
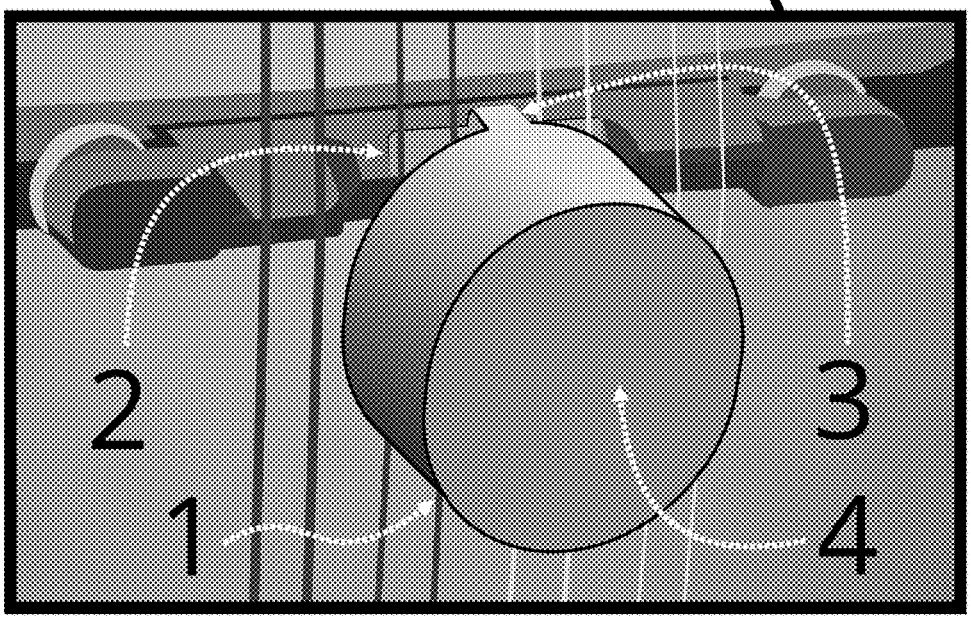
FIG. 17. An expanded view of FIG. 16 highlighting the means of attaching the device to the mandolin.
Figure 20:
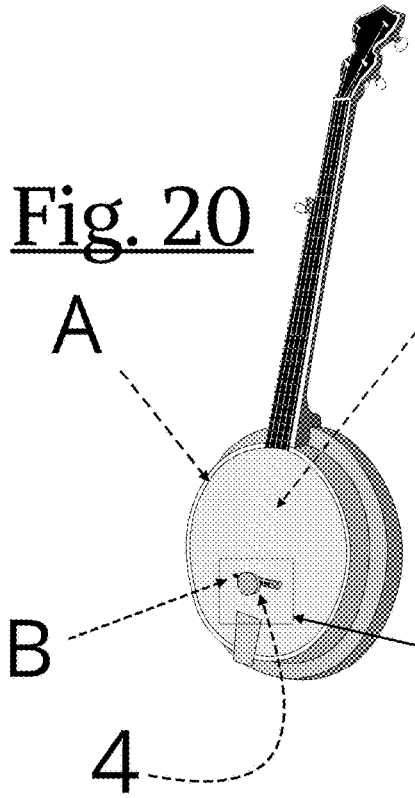
FIG. 20. A perspective view of an alternative embodiment of the device attached to the strings of a banjo.

FIG. 17 is an exploded perspective view of FIG. 20 depicting an embodiment of the present invention as previously depicted in FIG. 1-5, shown here on a mandolin A.

Figure 18:
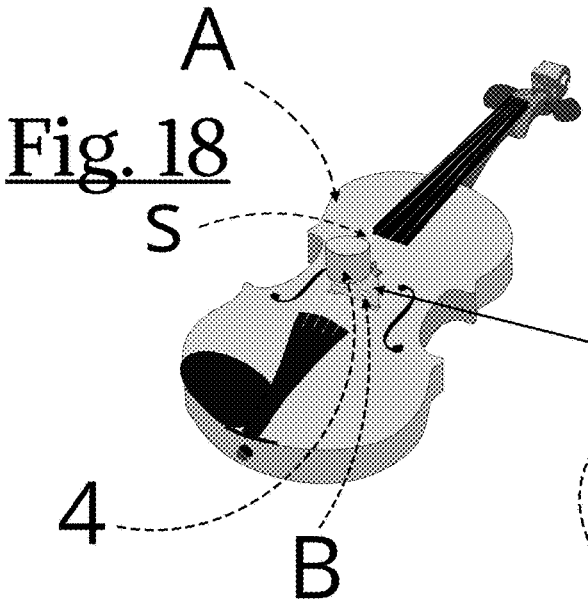
FIG. 18. A perspective view of an alternative embodiment of the device attached to the strings of a violin.

FIG. 18 is a perspective view of an embodiment of the present invention 4 as previously depicted in FIGS. 6-10, shown attached to the bridge B and strings S of a violin A.

Figure 19:
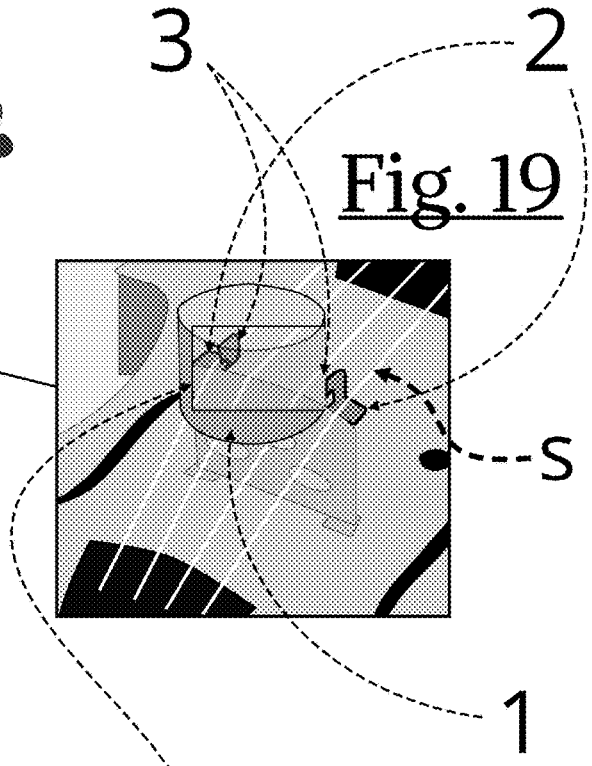
FIG. 19. An expanded view of FIG. 18 highlighting the means of attaching the device to the violin.

FIG. 19 is an exploded perspective view of FIG. 16 depicting an embodiment of the present invention as previously depicted in FIG. 6-10.

FIG. 20 is a perspective view of an embodiment of the present invention as previously depicted in FIGS. 11-15, shown here on a banjo.

Figure 21:
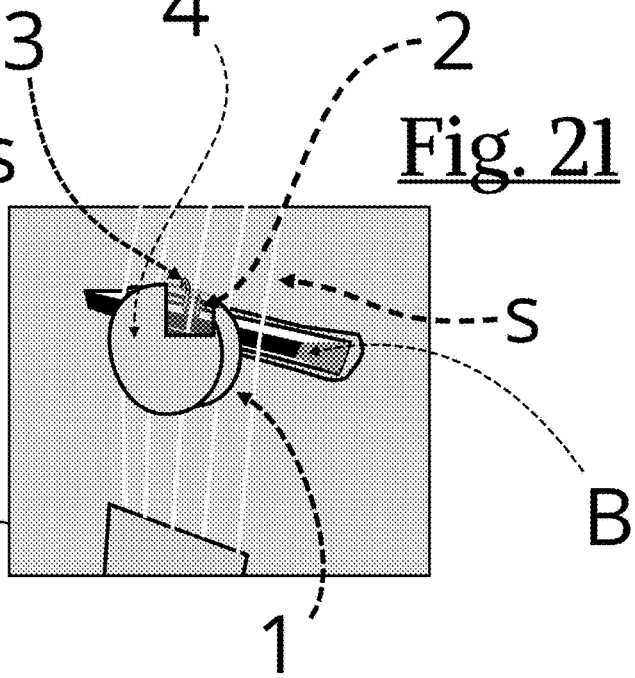
FIG. 21. An expanded view of FIG. 20 highlighting the means of attaching the device to the banjo.

FIG. 21 is an exploded perspective view of FIG. 18 depicting an embodiment of the present invention as previously depicted in FIG. 11-15, shown here on a banjo. The embodiment shows a depiction of the device having a singular hook 2.

These and other embodiments, advantages, and features of this invention will be apparent from the following description, drawings, and appended claims.

The invention claimed is:

1. A broad spectrum audio device designed to attach to an upright stringed musical instrument for the purpose of accelerating the maturation of a stringed musical instrument, comprising a cylindrical housing for a speaker, said cylindrical housing having a face that comes in contact with the bridge of the instrument and one to two hooks protruding from the bottom face of the cylindrical housing so that said hooks affix the device behind the strings of the upright stringed musical instrument, allowing the device to hang freely from the saddle of the stringed musical instrument so that the hooks rest at the junction of one or more strings and the saddle of the upright stringed musical instrument, allowing the cylindrical housing to hang freely against the bridge of the stringed musical instrument by means of its own weight without significantly muting the strings of the instrument, allowing them to vibrate freely.

2. The broad spectrum audio device of claim 1, having one or two hooks dimensioned to lie in direct contact with the bridge, pins, or saddle of the stringed musical instrument (depending on the configuration of the musical instrument) so as not to greatly dampen the strings further aiding in the realism of the accelerated maturation process and simulated use.

3. The broad spectrum audio device of claim 1 having one or two hooks dimensioned so that at no point, assuming proper installation and that the instrument is upright, do the hooks rely on friction, adhesion, spring tension, suction, or a "gripping" action to affix the device to any component of the stringed musical instrument; the device is instead detachably attached to the stringed musical instrument due to the hooks being entrapped by the tangent point formed between the bridge or saddle and the strings of the stringed musical instrument.

* * * * *